United States Patent [19]

Haytayan

[11] 4,253,598

[45] Mar. 3, 1981

[54] FLUID POWERED IMPACT TOOL

[76] Inventor: Harry M. Haytayan, Sunnyside La., Lincoln, Mass. 01773

[21] Appl. No.: 14,268

[22] Filed: Feb. 23, 1979

[51] Int. Cl.[3] ..... B25C 1/04

[52] U.S. Cl. ..... 227/119; 227/130

[58] Field of Search ..... 227/119, 123, 130, 139

[56] References Cited

U.S. PATENT DOCUMENTS

| | | | |
|---|---|---|---|
| 3,067,724 | 12/1962 | Jenny et al. | 227/130 |
| 3,554,428 | 1/1971 | Smith | 227/139 |
| 3,893,610 | 7/1975 | Smith | 227/130 |
| 3,908,884 | 9/1975 | Schrepferman | 227/130 |

*Primary Examiner*—John McQuade

*Attorney, Agent, or Firm*—Schiller & Pandiscio

[57] ABSTRACT

An improved power-driven hammer driver tool is provided wherein a pneumatically- or hydraulically-operated piston mounting a cylindrical rod-shaped hammer is designed to impart a vertically-oriented impact to an indexed fastener within the tool. A face plate is mounted between the driver tool foot portion, and an attached fastener feeding magazine. The face plate defines part of the hammer bore and incorporates an inclined semi-cylindrical fastener guide groove that enables a misaligned impact-driven fastener to be oriented into alignment by a camming action imparted to the fastener tip, thereby resulting in a fastener "anti-jamming" function that assures proper entry of the previously misdirected fastener into a waiting work surface.

14 Claims, 6 Drawing Figures

FLUID POWERED IMPACT TOOL

BACKGROUND OF THE INVENTION

The present invention relates to new and improved power driver impact tools, and in particular to a pneumatic- or hydraulically-operated hammer driver for driving fasteners, such as nails into hard substrates, particularly steel plate, or reinforced concrete, or steel plate overlying concrete.

A number of manual and pneumatic or hydraulically-operated impact tools have been designed for driving nails and other forms of impact installed fasteners into hard substrate materials such as metal, concrete, wood, thermo plastics, and other materials, with the fasteners being singly fed from a spring-biased clip magazine mechanism.

As exemplified in U.S. Pat. Nos, 3,711,008; 3,638,532; 3,278,103 and 3,952,398 and more particularly my recent U.S. Pat. No. 4,122,904, such tools generally consist of a guide track in the form of a bore along which a hammer or driver is reciprocated, and a side opening whereby fasteners may be introduced singly into the hammer bore in position to be intercepted and driven by the hammer when the latter undergoes its drive stroke. In essence, a compressed gas or liquid is caused to act upon a piston in order to drive the hammer against the fastener head surface, and thereby impact-installing the fastener into the hard work surface.

While it is technically possible to load the attached fastener supply magazine on a one fastener at a time basis, it is clear that the fastener loading process can be improved and speeded significantly if the fasteners are first pre-assembled in a serially-connected clip arrangement. This utilization of a serially-arranged fastener clip structure would lead to an increased efficiency in the operation of the pneumatic or hydraulic hammer driver tool.

Accordingly, this arrangement of an improved fastener clip structure has been devised and described in my earlier U.S. Pat. No. 4,106,618. This assembly of a plurality of fasteners in the form of a clip in which the fasteners are interconnected serially for both easy handling and installation into the hammer drive tool, leads to the result that on successive cycles of operation of the hammer driver tool, the serially-aligned fastener strip is being advanced by a spring biased mechanism in the attached magazine, thereby inserting or indexing another fastener into the hammer bore, with the resultant impact of the hammer shearing the fastener from the attached strip and driving the fastener into the work surface below.

In many of the prior art magazine fed power driven impact tools, particularly where the fasteners are held together by a connecting strip, there has existed the problem of a tendency for the tool to become jammed during its operation as a result of the fasteners being impacted off center by the hammer, i.e., the fasteners are struck by the hammer before they are centrally positioned in the hammer bore. The latter condition can occur because of a weakness developed by the spring of the fasteneer feeding mechanism of the magazine or because the tool is refired by the operator before a new fastener can be indexed fully into the hammer bore. Impacting the fasteners off center causes them to be canted, i.e., directed downward at an angle to the central axis of the hammer bore. One problem that may be caused by the canting action is a reduction of the impact velocity imparted to the fastener, with the attendant consequence being that the fastener is unable to penetrate the hard work surface or penetrates it only part way. However, particularly in the utilization of fasteners where they are gripped by a connecting strip over only a short portion of their length, there arises the likelihood of a greater detriment-fastener jamming within the hammer bore following the impact imparted to the fastener by the hammer. If the fastener is not centrally seated in the hammer bore prior to the hammer impact, on impact by the hammer the fastener tip will be deflected towards the magazine side of the hammer bore wall with the attendant jamming of the tool.

The present invention has overcome this previously major problem by incorporating between the fastener magazine and the tool foot portion a face plate anti-jamming device that provides a recess which forms part of the hammer bore, along with an integrally designed inclined fastener guide groove surface that functions to restore a vertical direction of travel to a canted impact-driven fastener, thereby eliminating the previously described jamming tendency of the driver tool. In the event that the fastener is impacted while being in an offset position from the impact surface of the hammer head, the fastener may tend to travel in an angular direction not coaxial with the hammer bore. Because of the fact that the fastener is still coupled to the strip of fasteners when it is struck by the hammer, it will tend to be canted so that its tip is directed toward the magazine. In such event the tip of the fastener will, in its downward and deflected path of travel, emerge through the recessed hammer bore section of the present invention face plate and encounter the surface of the inclined semi-cylindrical fastener guide groove. Sliding contact of the fastener tip with the fastener guide groove surface results in a "camming action" being imparted to the tip of the descending fastener, whereby it is realigned with the hammer bore and driven out of the tool into the impact work surface.

OBJECTS OF THE INVENTION

Accordingly, the primary object of the present invention is to provide a power driven, manually-operated hammer driver tool which is not subject to the foregoing disadvantages.

It is another object of the present invention to provide a pneumatically or hydraulically driven hammer driver tool which incorporates means for reducing fastener jamming problems of the types described above.

It is yet another object of the present invention to provide a power-driven magazine fed nailing tool which is less prone to breakdown than heretofore and in which critical parts are readily accessible for service.

Further, it is still yet another object of the present invention to provide a driver tool which resists fastener jamming when used with fasteners of different lengths and thicknesses, as well as with fasteners having tips of varying cross-sectional shapes or configurations, i.e., circularly-shaped, square-shaped, triangular-shaped, etc.

These and other objects of the present invention together with the numerous features and advantages thereof, will become readily apparent from the following expanded detailed specifications when read in conjunction with the accompanying drawings.

BRIEF DESCRIPTION OF TH DRAWINGS

DESCRIPTION OF THE INVENTION

Figure 1:
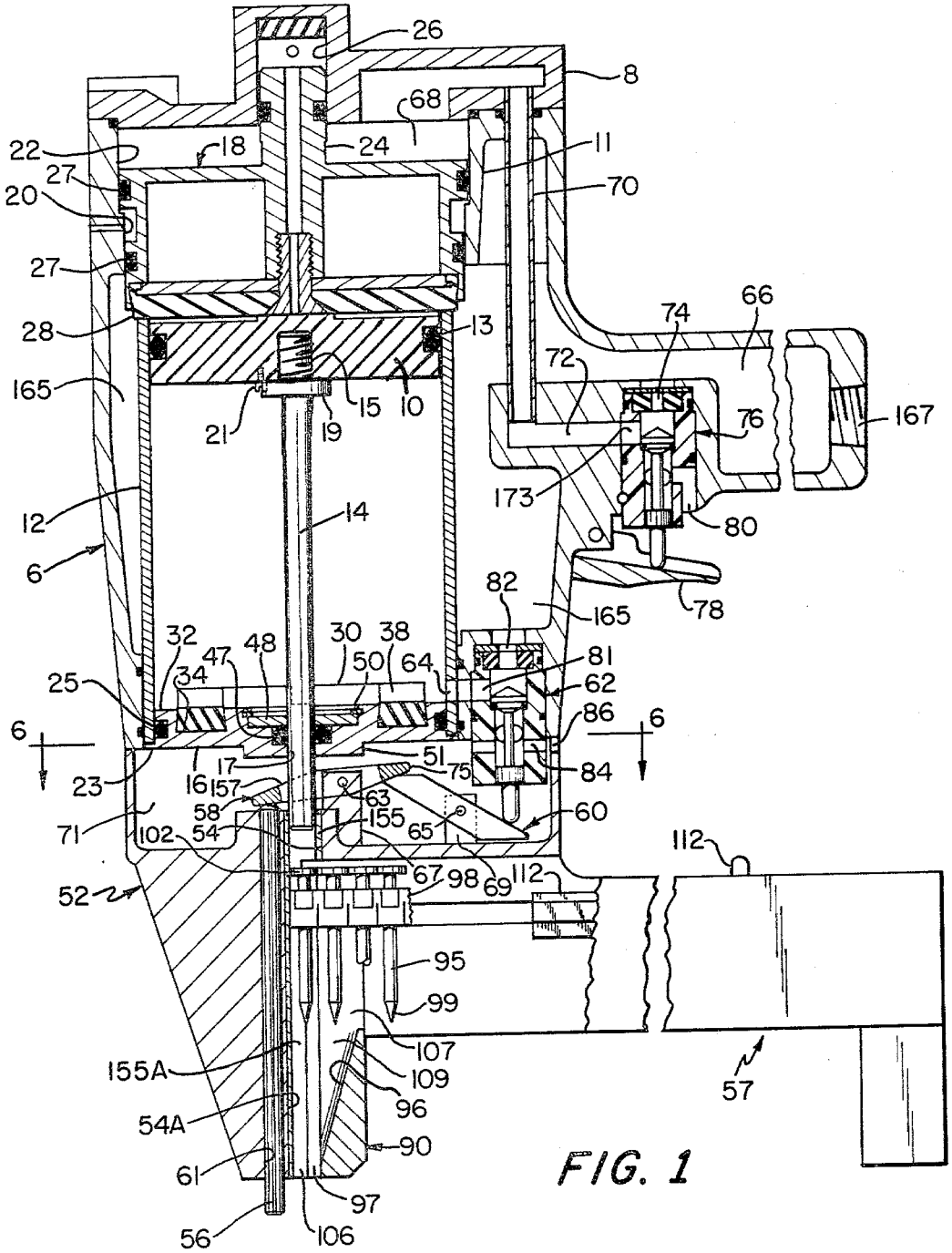
FIG. 1 is a cross-sectional view in elevation of a preferred form of pneumatic hammer driver tool incorporating the present invention, with a serially-connected fastener clip in operating position.

Unless otherwise stated, like numerals are used to refer to like parts in the several figures of the drawing.

The illustrated tool is generally the same as the apparatus disclosed in my recently issued U.S. Pat. No. 4,122,904. As shown in FIG. 1, a piston 10 is slidably disposed within a cylinder 12 secured within a housing 6 and a seal between the piston and cylinder 12 is provided by O-ring 13. A hammer 14 in the form of a rod is secured to the underside of piston 10 by means of a threaded end 15 which screws into a bore in the piston 10. When the hammer 14 is fully inserted, hammer flange 19 abuts the underside of piston 10. A set screw 21 is positioned in a recess of flange 19, and is also threaded into the underside of piston 10. The set screw 21 prevents the hammer 14 from loosening under vibration during operation of the tool.

Cylinder 12 is open at its upper end. The lower end of cylinder 12 is closed off by end wall 16 having a central hole 17, through which hammer 14 travels. Lip 23 of end wal 16 is positioned beneath cylinder wall 12. O-ring 25 is seated in a peripheral sealing contact with the cylinder wall 12. A circular boss 51 is coaxially formed on the underside of end wall 16.

A poppet valve 18 is slidably disposed coaxially and above the cylinder 12. As shown in FIG. 1, the lower portion of the poppet valve 18 rides in a bore 20, while the upper portion rides in a counterbore 22. An upper extension 24 of the poppet valve 18 is slidably disposed in a cylindrical cavity 26 formed in a cap member 8 that closes off the upper end of housing 6. O-rings 27 provide seals between poppet valve 18 and bore 20 and counterbore 22 of cylindrical wall 11 in housing 6. The lower end of poppet valve 18 terminates in a resilient cylindrical cover 28. In the position illustrated in FIG. 1 cover 28 makes sealing contact with the open end of cylinder 12.

Figure 6:
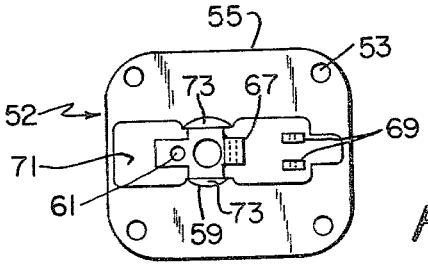
FIG. 6 is a reduced-size plan view of the foot portion of the present invention taken at line 6—6 in FIG. 1.

The driver tool also comprises a separable foot portion 52, further illustrated in FIGS. 2, 3 and 6 which supports a magazine 57 carrying a strip of fasteners 95 as hereinafter described.

Foot portion 52 is removably mounted onto the bottom end of the housing 6 of the driver tool by means of holes 53 in flange 55 of the foot portion 52 which accepts bolts. The foot portion 52 has a bore 54 which is provided with a liner sleeve 155 sized to accept and guide hammer 14 in its downward travel. As may be seen by reference to FIG. 1, liner sleeve 155 is further configured and sized to accept and guide a head 102 and a guide sleeve 98 of a fastener 95 to be driven by the tool. A cavity 71 comprises a partial counterbore 59, which is terminated by a pair of steps 73. When the foot portion 52 is fastened to the bottom end of housing 6, flange 55 abuts the lower surface of end wall 16, and secures the latter in place. In the latter position lip 23 of end wall 16 engages the bottom end face of cylinder 12 and boss 51 is seated in counterbore 59 and is engaged by steps 73. As a result, hammer 14 is precisely coaxially aligned with sleeve 155 and center hole 17.

Foot portion 52 also comprises a safety mechanism, which includes a shaft 56 positioned in a bore 61. As may be seen with reference to FIG. 1, the safety mechanism further includes linkage levers 58 and 60, which are pivotably mounted on pivot pins 63 and 65 respectively. Lever 58 comprises two parallel spaced arms, one of which is shown at 157, which are connected at their ends by cross members 75.

Pin 63 extends through arms 157 and is supported in a square boss 67 which is positioned within cavity 71 and which is integral with foot portion 52. Pin 65 is supported in a pair of square bosses 69 which are similarly integral with the foot portion and positioned inside cavity 71. Boss 67 is located between arms 157 while lever 60 is disposed between bosses 69. The safety mechanism further includes a control valve 62, the function of which will be explained below.

Cylinder 12 is surrounded by a reservoir 165 which communicates directly with a manifold 66 that is adapted to be connected to a source of high pressure gas, such as air, through a coupling at opening 167. The space above poppet valve 18 defines a chamber 68 which varies in size with the position of the poppet valve. Chamber 68 communicates with manifold 66 by way of a conduit 70, another passage 72, and through ports 173 and 74 of a control valve 76 when such valve is set to its normal position as shown in FIG. 1. When trigger 78 is squeezed, the movable valve element of valve 76 closes off port 74 and chamber 68 is vented to atmosphere by way of port 173 and a third port 80 of valve 76.

Cylinder 12 includes a port 64 extending through the cylindrical wall and positioned adjacent to and above end wall 16. The interior of cylinder 12 communicates with reservoir 165 by way of port 64 and via ports 81 and 82 of control valve 62. Valve port 82 is open when valve 62 is set to its normal position as shown in FIG. 1. As shown, valve 62 also includes several ports 84 which communicate with several ports 86 (only one is shown) in the wall of the cavity section of foot 52. In the position of valve 62 shown in FIG. 1, both the latter ports are closed off from reservoir 65 and the interior of cylinder 12.

A resilient piston cushion 30 extends to a predetermined height above interior surface 32 of end wall 16. As illustrated in FIG. 1, cushion 30 is configured as an annular ring. The cushion is anchored in an annular groove 34 coaxially formed in end wall 16.

Annular ring cushion 30 includes a plurality of radial slots 38 of limited depth. In the illustrated preferred embodiment of the invention, only the portion of the annular ring that extends above interior surface 32 is slotted. It will also be seen that the dimensions of annular ring 30 are such that the radial distance between hammer 14 and ring 30 is substantially greater than the radial distance between ring 30 and the cylindrical wall of cylinder 12.

As illustrated in FIG. 1, central hole 17 in end wall 16 contains a resilient rod seal 47 which makes sealing contact between reciprocating hammer 14 and end wall 16. A counterbore in end wall 16 accommodates a thrust washer 48 which serves to retain rod seal 47 in place and also to guide hammer 14 as it reciprocates. A snap ring 50 disposed in an annular groove in end wall 16 serves to retain washer 48 in position.

The dimensions of annular ring cushion 30 are such that port 64 remains free to communicate with the interior cylindrical space defined between piston 10 and interior end wall surface 32 and this remains true when the piston contacts the cushion. Specifically, port 64 remains free to communicate with the space surrounding cushion 30 as well as with the interior space encompassed by the annular cushion, by means of radial slots 38.

In operation, when control valve 76 is in the position shown in FIG. 1, air applied to manifold 66 through opening 167 is transmitted to chamber 68 through valve port 74, port 173, passage 72 and conduit 70. The pressure so applied to the top surface of poppet valve 18 urges the latter in a downward direction such that resilient cover 28 of the poppet valve makes sealing contact with the open end of cylinder 12. Pressurized air also reservoir 165 (which is open to manifold 66) and exerts an upward force on the bottom part of poppet valve 18, i.e., on the portions that protrude beyond cylinder 12. However, since the effective surface area of the top portion of valve 18 is greater than the bottom portion, valve 18 remains in the position shown in FIG. 1. Pressurized air from reservoir 165 also enters the interior of cylinder 12 through valve port 82 and cylinder port 64. The force exerted by the air on the underside of the piston urges the latter to the upward position shown, i.e., into contact with resilient poppet valve cover 28.

If it is desired to drive a fastener 95, typically a nail having a broad, flat head 102 and a small shank terminating in a pointed tip 99 (FIG. 1), a pneumatic driver is positioned over the designated spot on the work surface. The force bearing down on the tool causes the work surface to exert an upward force on shaft 56, which retracts within foot portion 52. The latter action is transmitted by way of linkage 58, 60 to cause valve 62 to be set to its other position. In the latter position, valve port 82 is closed and the interior of cylinder 12 is vented to atmosphere by way of cylinder port 64, valve ports 81 and 84 and ports 86 in the wall of foot section 52.

If trigger 78 is now pulled, valve 76 is set to its other position in which valve port 74 is closed and chamber 68 is vented to atmosphere via ports 173 and 80. The pressure differential between the top and bottom portions of poppet valve 18 now shifts in favor of the bottom portion, so that the valve is caused to move upward and the pressurized air in reservoir 65 is applied to the top of piston 10. Piston 10 is thus impelled downward at a rapid rate to cause hammer 14 to be driven against the fastener 95 introduced into the hammer bore from the attached magazine 57. The latter action expels the nail from the bore and drives it into the work surface below.

As the descending hammer 14 drives the fastener home such that the head of the fastener strikes the work surface, the hammer driver is caused to recoil and foot portion 52 lifts off the work surface. When this occurs, shaft 56 is again able to protrude from foot 52 and valve 62 resumes the setting illustrated in FIG. 1. Pressurized air from reservoir 165 again enters the interior of cylinder 12 to provide a pressure against the underside of piston 10. After a nail is driven, trigger 78 is released and the setting of valve 76 shown in FIG. 1 is reestablished. When this occurs, poppet valve 18 is again moved downward into sealing contact with the open end of cylinder 12, whereupon the piston will be returned rapidly to its normal raised position ready for another nail-driving operation.

The length of hammer 14 is chosen so that, when the free end of the hammer shaft first drives the head of the fastener into contact with the work surface, piston 10 is either positioned just short of cushion 30, or in contact with the cushion without compressing the latter. Since the height of port 64 extends to approximately 1/16 to ⅛ inch below the upper surface of cushion 30, it remains open for the full length of the power stroke of the hammer so that air under piston 10 can exhaust to atmosphere through the path established by ports 64, 84 and 86. This also applies to the volume of air inside the annular ring cushion, the trapping of such air by the descending piston being avoided by exhausting through slots 38. As a consequence, the descending piston encounters less air resistance during the power stroke and the hammer is able to deliver a more powerful blow. Further, wear on the cushion is minimized by the multichannel distribution of the air flow provided by slots 38.

Turning again to FIGS. 1–3, the foot portion 52 is cut away along the center line of bore 54 for a substantial distance so as to form two flat surfaces 94, best shown in FIG. 3 on opposite sides of the remaining half-section 54*a* of bore 54. In the illustrated embodiment sleeve 155 also is cut away like foot portion 52 so that a substantial section 155A thereof is semicylindrical.

Figure 2:
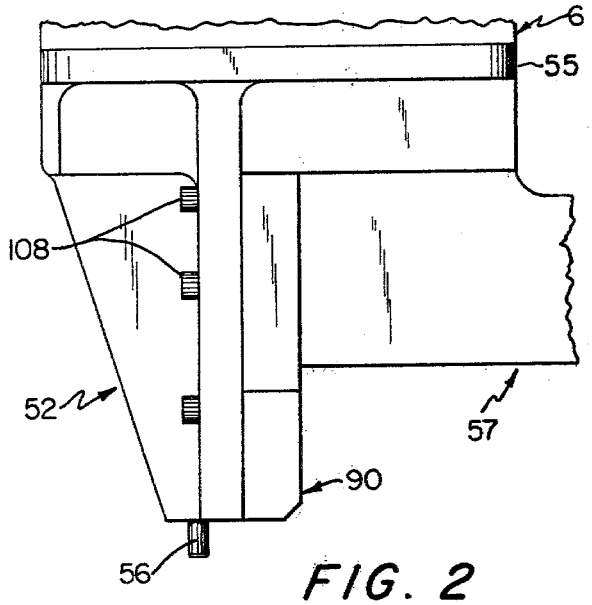
FIG. 2 is a side elevation of the tool foot portion with the attached face plate device showing a portion of the magazine attached.
Figure 3:
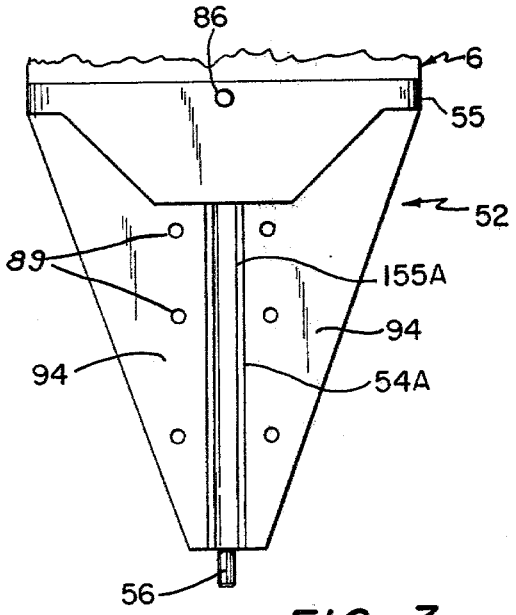
FIG. 3 is a rear elevation view of the tool foot portion of the present invention.

As may be seen by reference to FIGS. 1 and 2, sandwiched between foot portion 52 and magazine 57 is a face plate 90 constructed in accordance with this invention. Face plate 90 is made of hardened steel, e.g., Rockwell hardness 50–56, and is removably mounted to the foot portion 52 by means of bolts 108 which extend through holes 89 drilled through the foot portion and are screwed into threaded bores 91 in the face plate.

The rear side of face plate 90 also has flat surfaces which are engaged by matching flat surfaces of magazine 57. The face plate is secured to the magazine by means of socket bolts 101 which pass through holes in the face plate and are screwed into tapped holes in the end wall 113 of the magazine.

Figure 4:
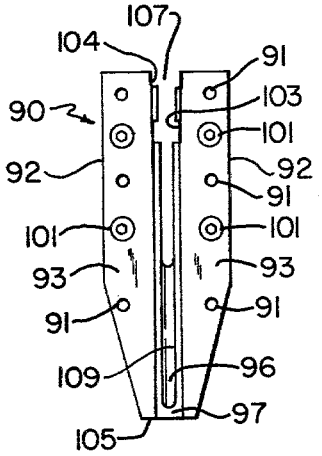
FIG. 4 is a front elevation view of the face plate apparatus of the present invention, detached from the tool foot portion, as well as the magazine.

As seen in FIG. 4, face plate 90 is U-shaped, comprising half sections 92 which are joined at their bottom ends. These half sections 92 have flat front surfaces 93 that engage the flat surfaces 94 of foot section 52, plus a circularly curved semicylindrical surface 97 having the same radius of curvature as the inner surface of liner sleeve 155. This surface 97 coacts with the cut away section 155A of sleeve 155 to define a cylindrical bore which is an extension of the cylindrical passageway defined by the upper part of sleeve 155 and terminates in a discharge orifice 106, shown in FIG. 1, through which the hammer 14 travels to drive an indexed fastener 95 into the work surface. As may be seen by comparing FIG. 1 with FIGS. 3 and 4, this cylindrical passageway is dimensioned to just accommodate a head 102 and a guide sleeve 98 of a fastener 95. Referring again to FIG. 4, the space 107 between the two portions of the face plate 90 forms a side opening through which fasteners 95 can be delivered from the magazine, the heads 102 and guide sleeves 98 of the fasteners being accommodated by notch 104 and grooves 103, as will be described hereinafter. At the lower third region of the face plate 90 in the region of the interconnection between the two symmetrical half sections 93, the surface 97 of the face plate is cut away or recessed as shown at 109 (FIG. 1) so as to provide an inclined elongated fastener guide groove 96 with a circularly-curved cross-section. As may be seen by reference to FIG. 4, the width of recess 109 is less than that of space 107 and less than the width of semicylindrical surface 97. Inclined groove 96 is directed downwardly towards the foot portion 52 away from the magazine and arises at or near the face plate surface abutting the magazine 57. Groove 96 intersects semicylindrical surface 97 near the lower end 105 of face plate 90. Groove 96 starts near but slightly below the level of the bottom ends of the fasteners 95 supported in magazine 57.

This inclined fastener guide groove 96 serves a most critical function. Following the impact of an indexed fastener 95 by the hammer 14, the fastener guide groove 96 becomes the point of contact for the fastener tip 99 in the event that a cycle of operation results in a fastener 95 being directed toward the magazine instead of coaxially along the liner sleeve 155. In this respect, it should be noted that, due to its width, recess 109 will not accommodate either the head 102 or the guide sleeve 98 of a fastener 95, these two portions being slidably captivated by liner sleeve 155A and semicylindrical surface 97 as a fastener is propelled downward by hammer 14. Only a portion of a fastener 95 adjacent tip 99 can enter recess 109 and gain access to guide groove 96. The fastener guide groove 96 intercepts the fastener tip and thus functions as a cam surface to direct the canted fastener 95 back into full alignment with liner sleeve 155. The above leads to the "anti-jamming" function of the present invention, as the fastener 95 is "rightened" or oriented vertically back into coaxial alignment with the hammer in the course of its travel prior to its discharge from orifice 106 into the work surface.

It should be carefully noted that the cut away or recessed region 109 of the face plate allows an "offset" fastener tip 99 to come into sliding directional contact with the surface defining the inclined fastener guide groove 96. This combination of the inclined fastener guide groove 96 and the recessed region of the face plate facilitates and accomplishes the "anti-jamming" function of the present invention.

Figure 5:
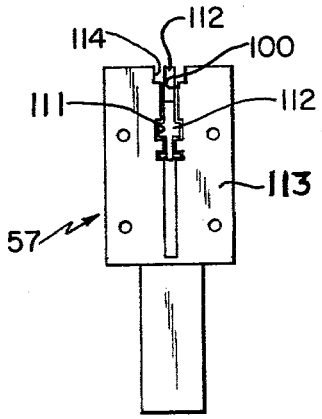
FIG. 5 is a front elevation view of the spring-fed fastener magazine of the present invention detached from the face plate apparatus.

The space 107, grooves 103 and notch 104 between the face plate sections 92 serve as a side opening to the hammer guideway defined by the section 155A of sleeve 155 and the curved surface 97. The serially-connected fasteners 95, joined together by plastic guide sleeve 98, are fed through the space 107, grooves 103, and notch 104 by a spring-biased feed mechanism 112 located in a fastener feed channel 100 of magazine 57, shown in FIG. 5. As may be seen by comparing FIGS. 4 and 5, fastener feed channel 100 of magazine 57 is similar in shape and size to space 107 of face plate 90. The magazine has guide grooves 111 at the side of its feed channel which are engaged by and serve as guides for ribs formed in the opposite sides of mechanism 112 and sleeves 98.

As shown in FIG. 4 corresponding grooves 103 are formed by projections on the interior walls of the face plate sections 92 at the level of the upper end of semicylindrical surface 97. These grooves 103 serve as the guiding and indexing tracks for the plastic guide sleeve 98 carrying the fasteners 95, whereby the fasteners 95 held in a serial arrangement by the plastic sleeve 98 are fed under spring tension from their storage within magazine 57 through face plate 90 into the sleeve 155 in position to be impacted by hammer 14. In a similar manner, a notch 104, dimensioned to accommodate a head 102 of a fastener 95 is formed in face plate 90, and a corresponding notch 114 is formed in that portion of magazine 57 which underlies housing 6.

It will be clear that the invention described and illustrated herein lends itself to various modifications and substitutions. Thus, for example, the face plate may be made an integral part of the fastener magazine, i.e., be made as the end wall of the magazine which engages the foot portion 52. Also the angle at which groove 96 is made is variable although the preferred angle is 20° away from the hammer axis. However, groove 96 may also be between about 10° and 45° from the hammer axis.

Also the length of groove 96 will vary according to the length of the fasteners. Preferably the groove starts about $\frac{1}{4}$ inch below the fasteners as they travel from the magazine through the face plate. Also groove 96 may intersect the semicylindrical surface 97 nearer to or further from its bottom end, according to the respective lengths of the quideway and the fasteners.

The present invention may be used in tools which are hydraulically operated, even though the preferred embodiment herein described is pneumatically-operated.

In view of the foregoing discussion, it will be apparent that numerous modifications, substitutions and changes will now occur to those skilled in the art, all of which fall within the spirit and scope of the present invention as defined by the claims hereto.

What is claimed is:

1. In a fastener driving tool suitable for driving fasteners having a pointed tip portion and a headed portion which is larger in diameter than said tip portion and upon which said fasteners may be impacted to be driven tip first into a workpiece, said driving tool comprising:

means defining (a) a hammer guideway which terminates in a fastener discharge opening and (b) a fastener-feeding opening in the side of said guideway, said guideway being so dimensioned and configured as to accommodate at all positions along said guideway between and including those of said fastener discharge opening and of said fastener-feeding opening all portions of a fastener to be driven;

means for feeding fasteners one at a time through said fastener-feeding opening into said guideway, said means for feeding fasteners including a fastener-holding magazine alongside said guideway and communicating with said fastener-feeding opening;

a hammer slidably disposed in said guideway for impacting fasteners disposed in said guideways and discharging said impacted fasteners from said tool via said fastener opening, said hammer being movable in said guideway between a first retracted position short of said fastener-feeding opening and a second extended position beyond said fastener-feeding opening; and means for reciprocating said hammer between said first and second positions;

the improvement comprising a groove-defining cam surface which is disposed to one side of said guideway and situated between and distinct from said fastener-feeding opening and said fastener discharge opening, said groove being so dimensioned as to accept only a tip portion of said fastener, said cam surface being directed from said fastener-holding magazine toward said guideway and inclined with respect to said guideway so as to exert a camming action on the tip portions of said fasteners disposed in said guideway which tend to assume a canted position relative to said guideway when impacted by said hammer.

2. Apparatus according to claim 1 wherein said cam surface intersects said guideway adjacent to said fastener discharge opening.

3. Apparatus according to claim 1 wherein said tool comprises a foot section defining at least a part of said guideway, and said fastener-holding magazine is attached to said foot section.

4. Apparatus according to claim 3 further including a plate interposed between said magazine and said foot section, said cam surface being part of said plate and said plate having said fastener-feeding opening for allowing fasteners to move from said magazine to said hammer guideway.

5. Apparatus according to claim 4 wherein said guideway is defined in part by said foot section and in part by said plate.

6. Apparatus according to claim 5 wherein the portion of said cam surface which is furthest from said guideway commences below the level of said fastener-feeding opening.

7. Apparatus according to claim 4 wherein said plate has means for guiding fasteners along said fastener-feeding opening.

8. Apparatus according to claim 1 wherein said tool comprises a section which partially defines said hammer guideway, and further including a plate attached to said section which partially defines said hammer guideway and also defines said cam surface.

9. Apparatus according to claim 8 wherein said plate also defines a passageway whereby fasteners can be delivered into said guideway.

10. Apparatus according to claim 8 wherein said plate is U-shaped, being characterized by two like sections which are joined together by a connecting section adjacent their bottom ends, said connecting section having an inclined groove defined at least in part by said cam surface.

11. Apparatus according to claim 4 wherein the plate is made of hardened steel.

12. Apparatus according to claim 4 wherein said plate is a single member.

13. Apparatus according to claim 1 wherein said hammer guideway is of substantially constant cross-section throughout.

14. Apparatus according to claim 13 wherein said hammer guideway is of substantially circular cross section.

* * * * *

UNITED STATES PATENT AND TRADEMARK OFFICE

CERTIFICATE OF CORRECTION

PATENT NO. : 4253598

DATED : March 3, 1981

INVENTOR(S) : Harry M. Haytayan

It is certified that error appears in the above-identified patent and that said Letters Patent are hereby corrected as shown below:

Claim 1, column 8, line 54, the word "guideways" should be -- guideway --.

Claim 1, column 8, line 56, the word "discharge" should be inserted after -- fastener -- and before -- opening --.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*